US009194134B2

(12) United States Patent
Nygren et al.

(10) Patent No.: US 9,194,134 B2
(45) Date of Patent: Nov. 24, 2015

(54) BUILDING PANELS PROVIDED WITH A MECHANICAL LOCKING SYSTEM

(71) Applicant: Välinge Innovation AB, Viken (SE)

(72) Inventors: Per Nygren, Ramlösa (SE); Marcus Bergelin, Lerberget (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

(21) Appl. No.: 14/200,909

(22) Filed: Mar. 7, 2014

(65) Prior Publication Data

US 2014/0250813 A1 Sep. 11, 2014

Related U.S. Application Data

(60) Provisional application No. 61/774,749, filed on Mar. 8, 2013.

(51) Int. Cl.
*E04F 15/02* (2006.01)
*E04F 15/10* (2006.01)

(52) U.S. Cl.
CPC ..... *E04F 15/02038* (2013.01); *E04F 15/102* (2013.01); *E04F 2201/0153* (2013.01); *E04F 2201/0511* (2013.01); *E04F 2201/0547* (2013.01); *E04F 2201/0588* (2013.01)

(58) Field of Classification Search
CPC ..... E04F 13/0894; E04F 15/02038; E04F 2201/0547; E04F 2201/0541; E04F 2201/0523; E04F 2201/0511
See application file for complete search history.

(56) References Cited

U.S. PATENT DOCUMENTS 261,030 A 7/1882 Orcutt
301,775 A 7/1884 Thompson
526,044 A 9/1894 Merrill
(Continued)

FOREIGN PATENT DOCUMENTS

CA 2456513 A1 2/2003
DE 299 22 649 U1 4/2000
(Continued)

OTHER PUBLICATIONS

International Search Report mailed May 28, 2014 in PCT/SE2014/050285, Patent-och Registreringsverket, Stockholm, SE, 4 pages.
(Continued)

*Primary Examiner* — Christine T Cajilig
(74) *Attorney, Agent, or Firm* — Buchanan Ingersoll & Rooney P.C.

(57) ABSTRACT

Building panels, such as floorboards, provided with a mechanical locking system. The mechanical locking system includes a displacement groove at a first edge of a first floorboard and a tongue groove at a second edge of a second floorboard A tongue is arranged in the displacement groove and is configured to cooperate, in a second position, with the tongue groove for vertical locking of the first and the second edge. The tongue includes, in a first position, an inner element and an outer element. The inner element is removable along the displacement groove, and is configured to cooperate with the outer element to obtain a displacement of the outer element towards the tongue groove and thereby obtain the second position. Said inner element and said outer element vertically overlap each other.

19 Claims, 5 Drawing Sheets

(56) References Cited

U.S. PATENT DOCUMENTS

| | | | |
|---|---|---|---|
| 917,352 | A | 4/1909 | Palmer |
| 1,352,620 | A | 9/1920 | Onsrud |
| 1,911,598 | A | 5/1933 | Ashmun |
| 2,005,647 | A | 6/1935 | Crouch |
| 2,054,828 | A | 9/1936 | Melde |
| 2,571,861 | A | 10/1951 | Gegumis |
| 2,791,247 | A | 5/1957 | Gerson |
| 2,863,185 | A | 12/1958 | Riedi |
| 2,876,812 | A | 3/1959 | Waldron |
| 3,082,802 | A | 3/1963 | Dickson et al. |
| 3,774,660 | A | 11/1973 | Morey et al. |
| 3,778,954 | A | 12/1973 | Meserole |
| 3,817,305 | A | 6/1974 | Gibbs |
| 3,913,642 | A | 10/1975 | Porter |
| 3,986,543 | A | 10/1976 | Slayton et al. |
| 4,082,129 | A | 4/1978 | Morelock |
| 4,151,869 | A | 5/1979 | Halloran et al. |
| 5,026,112 | A | 6/1991 | Rice |
| 5,182,892 | A | 2/1993 | Chase |
| 5,348,778 | A | 9/1994 | Knipp et al. |
| 5,694,730 | A | 12/1997 | Del Rincon et al. |
| 6,164,349 | A | 12/2000 | Hsieh |
| 6,164,351 | A | 12/2000 | Weathers |
| 6,345,481 | B1 | 2/2002 | Nelson |
| 6,363,677 | B1 | 4/2002 | Chen et al. |
| 6,386,250 | B1 | 5/2002 | Liu |
| 6,450,235 | B1 | 9/2002 | Lee |
| 6,617,009 | B1 | 9/2003 | Chen et al. |
| 6,685,391 | B1 | 2/2004 | Gideon |
| 6,804,926 | B1 | 10/2004 | Eisermann |
| 6,862,857 | B2 | 3/2005 | Tychsen |
| 6,874,291 | B1 | 4/2005 | Weber |
| 6,880,307 | B2 | 4/2005 | Schwitte et al. |
| 7,051,486 | B2 | 5/2006 | Pervan |
| 7,152,383 | B1 | 12/2006 | Wilkinson et al. |
| 7,337,588 | B1 | 3/2008 | Moebus |
| 7,451,578 | B2 | 11/2008 | Hannig |
| 7,454,875 | B2 | 11/2008 | Pervan et al. |
| 7,516,588 | B2 | 4/2009 | Pervan |
| 7,533,500 | B2 | 5/2009 | Morton et al. |
| 7,584,583 | B2 | 9/2009 | Bergelin et al. |
| 7,621,092 | B2 | 11/2009 | Groeke et al. |
| 7,634,884 | B2 | 12/2009 | Pervan |
| 7,637,068 | B2 | 12/2009 | Pervan |
| 7,644,742 | B2 | 1/2010 | Burkholder |
| 7,677,005 | B2 | 3/2010 | Pervan |
| 7,721,503 | B2 | 5/2010 | Pervan et al. |
| 7,726,088 | B2 | 6/2010 | Muehlebach |
| 7,757,452 | B2 | 7/2010 | Pervan |
| 7,802,411 | B2 | 9/2010 | Pervan |
| 7,841,144 | B2 | 11/2010 | Pervan et al. |
| 7,841,145 | B2 | 11/2010 | Pervan et al. |
| 7,841,150 | B2 | 11/2010 | Pervan |
| 7,856,789 | B2 | 12/2010 | Eisermann |
| 7,861,482 | B2 | 1/2011 | Pervan et al. |
| 7,866,110 | B2 | 1/2011 | Pervan |
| 7,908,815 | B2 | 3/2011 | Pervan et al. |
| 7,930,862 | B2 | 4/2011 | Bergelin et al. |
| 7,954,523 | B2 | 6/2011 | Liu |
| 7,980,041 | B2 | 7/2011 | Pervan |
| 8,033,074 | B2 | 10/2011 | Pervan |
| 8,042,311 | B2 | 10/2011 | Pervan |
| 8,061,104 | B2 | 11/2011 | Pervan |
| 8,079,196 | B2 | 12/2011 | Pervan |
| 8,112,967 | B2 | 2/2012 | Pervan et al. |
| 8,171,692 | B2 | 5/2012 | Pervan |
| 8,181,416 | B2 | 5/2012 | Pervan et al. |
| 8,191,334 | B2 | 6/2012 | Braun |
| 8,234,830 | B2 | 8/2012 | Pervan et al. |
| 8,281,549 | B2 | 10/2012 | Du |
| 8,302,367 | B2 | 11/2012 | Schulte |
| 8,341,914 | B2 | 1/2013 | Pervan et al. |
| 8,341,915 | B2 | 1/2013 | Pervan et al. |
| 8,353,140 | B2 | 1/2013 | Pervan et al. |
| 8,359,805 | B2 | 1/2013 | Pervan et al. |
| 8,381,477 | B2 | 2/2013 | Pervan et al. |
| 8,387,327 | B2 | 3/2013 | Pervan |
| 8,448,402 | B2 | 5/2013 | Pervan et al. |
| 8,499,521 | B2 | 8/2013 | Pervan et al. |
| 8,505,257 | B2 | 8/2013 | Boo et al. |
| 8,528,289 | B2 | 9/2013 | Pervan et al. |
| 8,544,230 | B2 | 10/2013 | Pervan |
| 8,544,234 | B2 | 10/2013 | Pervan et al. |
| 8,572,922 | B2 | 11/2013 | Pervan |
| 8,596,013 | B2 | 12/2013 | Boo |
| 8,627,862 | B2 | 1/2014 | Pervan et al. |
| 8,640,424 | B2 | 2/2014 | Pervan et al. |
| 8,650,826 | B2 | 2/2014 | Pervan et al. |
| 8,677,714 | B2 | 3/2014 | Pervan |
| 8,689,512 | B2 | 4/2014 | Pervan |
| 8,707,650 | B2 | 4/2014 | Pervan |
| 8,713,886 | B2 | 5/2014 | Boo et al. |
| 8,733,065 | B2 | 5/2014 | Pervan |
| 8,733,410 | B2 | 5/2014 | Pervan |
| 8,763,341 | B2 | 7/2014 | Pervan |
| 8,769,905 | B2 | 7/2014 | Pervan |
| 8,776,473 | B2 | 7/2014 | Pervan et al. |
| 8,844,236 | B2 | 9/2014 | Pervan et al. |
| 8,857,126 | B2 | 10/2014 | Pervan et al. |
| 8,869,485 | B2 | 10/2014 | Pervan |
| 8,898,988 | B2 | 12/2014 | Pervan |
| 8,925,274 | B2 | 1/2015 | Darko et al. |
| 8,959,866 | B2 | 2/2015 | Pervan |
| 9,027,306 | B2 | 5/2015 | Pervan |
| 9,051,738 | B2 | 6/2015 | Pervan et al. |
| 9,068,360 | B2 | 6/2015 | Darko |
| 2002/0069611 | A1 | 6/2002 | Leopolder |
| 2002/0092263 | A1 | 7/2002 | Schulte |
| 2002/0170259 | A1 | 11/2002 | Ferris |
| 2003/0009971 | A1 | 1/2003 | Palmberg |
| 2003/0024199 | A1 | 2/2003 | Pervan et al. |
| 2003/0101681 | A1 | 6/2003 | Tychsen |
| 2004/0016196 | A1 | 1/2004 | Pervan |
| 2004/0049999 | A1 | 3/2004 | Krieger |
| 2004/0128934 | A1 | 7/2004 | Hecht |
| 2004/0177584 | A1 | 9/2004 | Pervan |
| 2004/0182036 | A1 | 9/2004 | Sjoberg et al. |
| 2004/0211143 | A1 | 10/2004 | Hanning |
| 2005/0160694 | A1 | 7/2005 | Pervan |
| 2005/0166514 | A1 | 8/2005 | Pervan |
| 2005/0210810 | A1 | 9/2005 | Pervan |
| 2006/0070333 | A1 | 4/2006 | Pervan |
| 2006/0101769 | A1 | 5/2006 | Pervan |
| 2006/0174577 | A1 | 8/2006 | O'Neil |
| 2006/0236642 | A1 | 10/2006 | Pervan |
| 2006/0260254 | A1 | 11/2006 | Pervan et al. |
| 2007/0006543 | A1 | 1/2007 | Engström |
| 2007/0011981 | A1 | 1/2007 | Eiserman |
| 2007/0028547 | A1 | 2/2007 | Grafenauer |
| 2007/0175156 | A1 | 8/2007 | Pervan et al. |
| 2007/0209736 | A1 | 9/2007 | Deringor et al. |
| 2007/0214741 | A1 | 9/2007 | Llorens Miravet |
| 2008/0000186 | A1 | 1/2008 | Pervan et al. |
| 2008/0000187 | A1 | 1/2008 | Pervan et al. |
| 2008/0010931 | A1 | 1/2008 | Pervan et al. |
| 2008/0010937 | A1 | 1/2008 | Pervan et al. |
| 2008/0017274 | A1 | 1/2008 | Burkholder |
| 2008/0028707 | A1 | 2/2008 | Pervan |
| 2008/0034708 | A1 | 2/2008 | Pervan |
| 2008/0041008 | A1 | 2/2008 | Pervan |
| 2008/0066415 | A1 | 3/2008 | Pervan |
| 2008/0104921 | A1 | 5/2008 | Pervan et al. |
| 2008/0110125 | A1 | 5/2008 | Pervan |
| 2008/0134607 | A1 | 6/2008 | Pervan |
| 2008/0134613 | A1 | 6/2008 | Pervan |
| 2008/0134614 | A1 | 6/2008 | Pervan |
| 2008/0155930 | A1 | 7/2008 | Pervan et al. |
| 2008/0209838 | A1 | 9/2008 | Pervan |
| 2008/0216434 | A1 | 9/2008 | Pervan |
| 2008/0216920 | A1 | 9/2008 | Pervan |
| 2008/0295432 | A1 | 12/2008 | Pervan et al. |
| 2009/0133353 | A1 | 5/2009 | Pervan et al. |
| 2009/0193748 | A1 | 8/2009 | Boo et al. |
| 2010/0043921 | A1 | 2/2010 | Liu |

(56) References Cited

U.S. PATENT DOCUMENTS

| | | | |
|---|---|---|---|
| 2010/0135740 | A1 | 6/2010 | Harif |
| 2010/0293879 | A1 | 11/2010 | Pervan et al. |
| 2010/0300031 | A1 | 12/2010 | Pervan et al. |
| 2010/0319290 | A1 | 12/2010 | Pervan |
| 2010/0319291 | A1 | 12/2010 | Pervan et al. |
| 2011/0030303 | A1 | 2/2011 | Pervan et al. |
| 2011/0041996 | A1 | 2/2011 | Pervan |
| 2011/0088344 | A1 | 4/2011 | Pervan et al. |
| 2011/0088345 | A1 | 4/2011 | Pervan |
| 2011/0154763 | A1 | 6/2011 | Bergelin et al. |
| 2011/0167750 | A1 | 7/2011 | Pervan |
| 2011/0225922 | A1 | 9/2011 | Pervan et al. |
| 2011/0252733 | A1 | 10/2011 | Pervan |
| 2011/0283650 | A1 | 11/2011 | Pervan et al. |
| 2012/0017533 | A1 | 1/2012 | Pervan et al. |
| 2012/0031029 | A1 | 2/2012 | Pervan et al. |
| 2012/0036804 | A1 | 2/2012 | Pervan |
| 2012/0151865 | A1 | 6/2012 | Pervan et al. |
| 2012/0174515 | A1 | 7/2012 | Pervan |
| 2012/0174520 | A1 | 7/2012 | Pervan |
| 2012/0279161 | A1 | 11/2012 | Håkansson et al. |
| 2013/0008117 | A1 | 1/2013 | Pervan |
| 2013/0014463 | A1 | 1/2013 | Pervan |
| 2013/0019555 | A1 | 1/2013 | Pervan |
| 2013/0042562 | A1 | 2/2013 | Pervan |
| 2013/0042563 | A1 | 2/2013 | Pervan |
| 2013/0042564 | A1 | 2/2013 | Pervan |
| 2013/0042565 | A1 | 2/2013 | Pervan |
| 2013/0047536 | A1 | 2/2013 | Pervan |
| 2013/0081349 | A1 | 4/2013 | Pervan et al. |
| 2013/0111845 | A1 | 5/2013 | Pervan |
| 2013/0145708 | A1 | 6/2013 | Pervan |
| 2013/0160391 | A1 | 6/2013 | Pervan et al. |
| 2013/0232905 | A2 | 9/2013 | Pervan |
| 2013/0239508 | A1 | 9/2013 | Darko et al. |
| 2013/0263454 | A1 | 10/2013 | Boo et al. |
| 2013/0263547 | A1 | 10/2013 | Boo |
| 2013/0318906 | A1 | 12/2013 | Pervan et al. |
| 2014/0007539 | A1 | 1/2014 | Pervan et al. |
| 2014/0020324 | A1 | 1/2014 | Pervan |
| 2014/0033634 | A1 | 2/2014 | Pervan |
| 2014/0053497 | A1 | 2/2014 | Pervan et al. |
| 2014/0059966 | A1 | 3/2014 | Boo |
| 2014/0069043 | A1 | 3/2014 | Pervan |
| 2014/0090335 | A1 | 4/2014 | Pervan et al. |
| 2014/0109501 | A1 | 4/2014 | Darko |
| 2014/0109506 | A1 | 4/2014 | Pervan et al. |
| 2014/0123586 | A1 | 5/2014 | Pervan et al. |
| 2014/0150369 | A1 | 6/2014 | Hannig |
| 2014/0190112 | A1 | 7/2014 | Pervan |
| 2014/0208677 | A1 | 7/2014 | Pervan et al. |
| 2014/0223852 | A1 | 8/2014 | Pervan |
| 2014/0237931 | A1 | 8/2014 | Pervan |
| 2014/0260060 | A1 | 9/2014 | Pervan et al. |
| 2014/0305065 | A1 | 10/2014 | Pervan |
| 2014/0366476 | A1 | 12/2014 | Pervan |
| 2014/0373478 | A2 | 12/2014 | Pervan et al. |
| 2015/0000221 | A1 | 1/2015 | Boo |
| 2015/0013260 | A1 | 1/2015 | Pervan |
| 2015/0167318 | A1 | 6/2015 | Pervan |

FOREIGN PATENT DOCUMENTS

| | | | | |
|---|---|---|---|---|
| DE | 200 01 788 | U1 | 6/2000 | |
| DE | 10 2004 055 951 | A1 | 7/2005 | |
| DE | 10 2006 024 184 | A1 | 11/2007 | |
| DE | 10 2006 037 614 | B3 | 12/2007 | |
| DE | 10 2007 018 309 | A1 | 8/2008 | |
| DE | 10 2007 016 533 | A1 | 10/2008 | |
| DE | 102007032885 | A1 * | 1/2009 | ..... E04F 15/02 |
| DE | 102011052335 | A1 * | 2/2013 | |
| EP | 1 420 125 | A2 | 5/2004 | |
| EP | 1 650 375 | A1 | 4/2006 | |
| EP | 1 650 375 | A8 | 9/2006 | |
| EP | 2 573 295 | A1 | 3/2013 | |
| FR | 1.138.595 | | 6/1957 | |
| FR | 2 256 807 | | 8/1975 | |
| FR | 2 975 717 | A1 | 11/2012 | |
| FR | 2 975 718 | A1 | 11/2012 | |
| SE | 529 076 | C2 | 4/2007 | |
| WO | WO 94/26999 | A1 | 11/1994 | |
| WO | WO 97/47834 | A1 | 12/1997 | |
| WO | WO 01/02671 | A1 | 1/2001 | |
| WO | WO 01/02672 | A1 | 1/2001 | |
| WO | WO 01/38657 | A1 | 5/2001 | |
| WO | WO 01/48332 | A1 | 7/2001 | |
| WO | WO 01/51732 | A1 | 7/2001 | |
| WO | WO 01/75247 | A1 | 10/2001 | |
| WO | WO 03/016654 | A1 | 2/2003 | |
| WO | WO 03/083234 | A1 | 10/2003 | |
| WO | WO 2004/048716 | A1 | 6/2004 | |
| WO | WO 2004/079130 | A1 | 9/2004 | |
| WO | WO 2004/085765 | A1 | 10/2004 | |
| WO | WO 2006/043893 | A1 | 4/2006 | |
| WO | WO 2006/104436 | A1 | 10/2006 | |
| WO | WO 2007/015669 | A2 | 2/2007 | |
| WO | WO 2007/089186 | A1 | 8/2007 | |
| WO | WO 2007/118352 | A1 | 10/2007 | |
| WO | WO 2008/004960 | A2 | 1/2008 | |
| WO | WO 2008/004960 | A8 | 1/2008 | |
| WO | WO 2008/017281 | A1 | 2/2008 | |
| WO | WO 2008/017301 | A2 | 2/2008 | |
| WO | WO 2008/017301 | A3 | 2/2008 | |
| WO | WO 2009/116926 | A1 | 9/2009 | |
| WO | WO 2010/006684 | A2 | 1/2010 | |
| WO | WO 2010/087752 | A1 | 8/2010 | |
| WO | WO 2010108980 | A1 * | 9/2010 | |
| WO | WO 2011127981 | A1 * | 10/2011 | |
| WO | WO 2013/025163 | A1 | 2/2013 | |

OTHER PUBLICATIONS

U.S. Appl. No. 14/206,214, Pervan, et al.

Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.

Engstrand, Ola (Contact)/Välinge Innovation AB, Technical Disclosure entitled "VA043 5G Linear Slide Tongue," IP com No. IPCOM000179015D, Feb. 4, 2009, IP.com Prior Art Database, 126 pages.

Engstrand, Ola (Owner)/Välinge Innovation AB, Technical Disclosure entitled "VA043b PCT Mechanical Locking of Floor Panels," IP com No. IPCOM000189420D, Nov. 9, 2009, IP.com Prior Art Database, 62 pages.

* cited by examiner

KNOWN TECHNOLOGY

BUILDING PANELS PROVIDED WITH A MECHANICAL LOCKING SYSTEM

CROSS REFERENCE TO RELATED APPLICATIONS

This application claims the benefit of Provisional Application No. 61/774,749 filed on Mar. 8, 2013. The disclosure of Provisional Application No. 61/774,749 is hereby incorporated by reference herein in its entirety.

TECHNICAL FIELD

The present disclosure relates to a building panel such as a floor panel, a wall panel, a ceiling panel, a furniture component or the like, which is provided with a mechanical locking system comprising a displaceable tongue.

TECHNICAL BACKGROUND

Building panels provided with a mechanical locking system comprising a displaceable tongue cooperating with a tongue groove for vertical locking is known and disclosed in, e.g., FR 2 975 717. The mechanical locking system in FR 2 975 717 has a displaceable tongue comprising an outer element which is pushed by a wedge part of a removable inner part of the tongue into a tongue groove, for vertical locking of adjacent edges of two floorboards. A drawback with this known system is that the locking strength is rather low.

The above description of various known aspects and drawback is the Applicant's characterization of such, and is not an admission that any of the above description is considered as prior art.

Although the description in the present disclosure relates to a floor panel, the description of techniques and problems thereof is applicable to other applications as well. For example, the description is also applicable to panels for other purposes, such as wall panels, ceiling panels, furniture panels and components, etc.

SUMMARY

It is an object of embodiments of the present disclosure to provide an improvement over the above described conventional techniques.

A further object of embodiments of the present disclosure is to provide building panels, such as floorboards, provided with a locking system that comprises a tongue that improves the vertical locking of the floorboards.

Another object of embodiments of the present disclosure is to provide a more efficient production method, which requires less complicated production equipment.

At least some of these and other objects and advantages that will be apparent from the present disclosure have been achieved by certain embodiments of the building panels described herein. The building panels, such as floorboards, are provided with a locking system that comprises a displacement groove at a first edge of a first floorboard and a tongue groove at a second edge of a second floorboard. A tongue is arranged in the displacement groove and is configured to cooperate, in a second position, with the tongue groove for vertical locking of the first edge and the second edge. The tongue comprises, in a first position, an inner element and an outer element. The inner element is removable along the displacement groove, and is configured to cooperate with the outer element to obtain a displacement of the outer element towards the tongue groove and thereby obtain the second position. The inner element and the outer element are preferably configured to vertically overlap each other in the first position to obtain an increased contact surface between a surface of the displacement groove and the outer element of the tongue in the second position. The inner element and the outer element are arranged such that the increased contact surface takes up a moment of force that arises on the tongue when a load is applied on the first or the second floorboard. The inner element in the first position may be arranged above or below the outer element. The inner element in the first position may also be arranged partly above partly behind the outer element, or may be arranged partly below the outer element and partly behind the outer element.

The entire outer element is in the first position preferably arranged within the displacement groove.

The outer element maybe provided with a guiding groove at either an inner and upper edge of the outer element or at an inner and lower edge of the outer element, wherein at least a part of the inner element in the first position is arranged in said guiding groove. The outer element may be provided with a guiding groove at an inner surface of the outer element, between an upper surface and lower surface of the outer element, wherein at least a part of the inner element is arranged in said guiding groove in the first position. The guiding groove facilitates the removal of the inner element by guiding the inner element in a controlled manner and provides a groove without obstructions and desired friction. The guiding groove preferably extends essentially along the whole longitudinal length of the outer element. This embodiment of the outer element provides for a simple production of the outer element for example by plastic profile extrusion and cutting of the profile in the desired length.

The inner element preferably comprises a first protruding part configured to cooperate with the guiding groove, to obtain said displacement of the outer element.

The first protruding part in the first position is preferably arranged outside of the outer element and/or in a recess of the outer element. When the inner element is removed by a displacement along the displacement groove and preferably in the guiding groove, the outer element is gradually pushed into the tongue groove to obtain the second position.

The first protruding part may be wedge shaped or of an essentially spherical shape. Such shapes facilitate the displacement of the inner element. The outer element may also be provided with guiding surfaces at the location of the first protruding part in the first position. The first protruding part is preferably elastic, to make it easier to displace the first protruding part over irregularities in the displacement groove. The first protruding part may comprise an elastic material and may be provided with a recess to increase the elasticity.

The inner element is preferably provided with a second protruding part, preferably configured such that the second protruding part is easy to grasp by an installer of the floorboards. The second protruding part may also be configured such that the inner element is secured in the correct position.

The cross section of the inner element may be L-shaped or rectangular or of an essentially circular shape.

The inner element may comprise plastic and may be produced by injection molding or extrusion. An extruded inner element of plastic may be provided with the first and or the second protruding part by heating and compressing a part of the extruded profile in a press tool.

The inner and outer element may be produced in one piece by injection molding of plastic and connected together by a connection configured to break when the inner element is displaced or when the tongue is inserted into the displacement groove.

The building panels may comprise a wood-based core, preferably made of at least one of MDF, HDF, OSB, WPC (Wood Powder Composite), and particleboard, or of plastic, such as vinyl or PVC.

BRIEF DESCRIPTION OF THE DRAWINGS

The present disclosure will by way of example be described in more detail with reference to the appended schematic drawings, which illustrate several embodiments.

DETAILED DESCRIPTION

Figure 1:
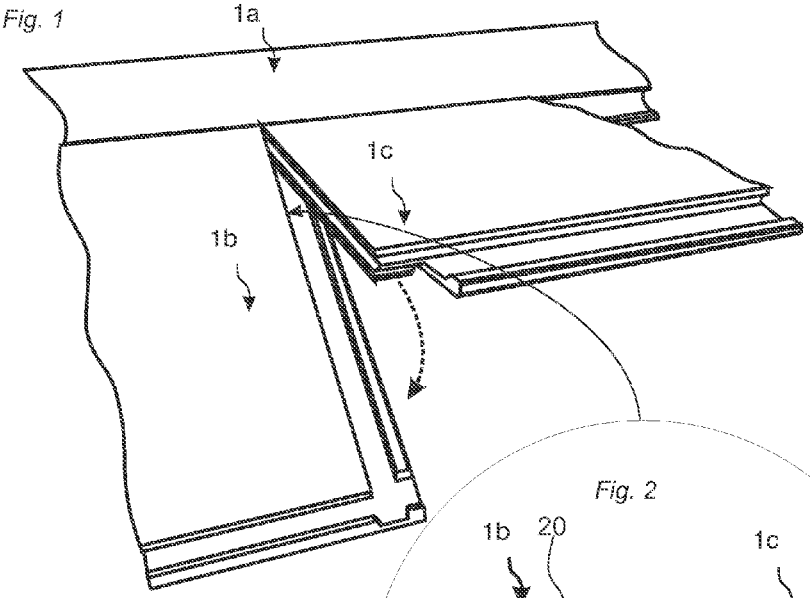
FIGS. 1-3 show a known locking system with a tongue comprising an inner and an outer element.
Figure 2:
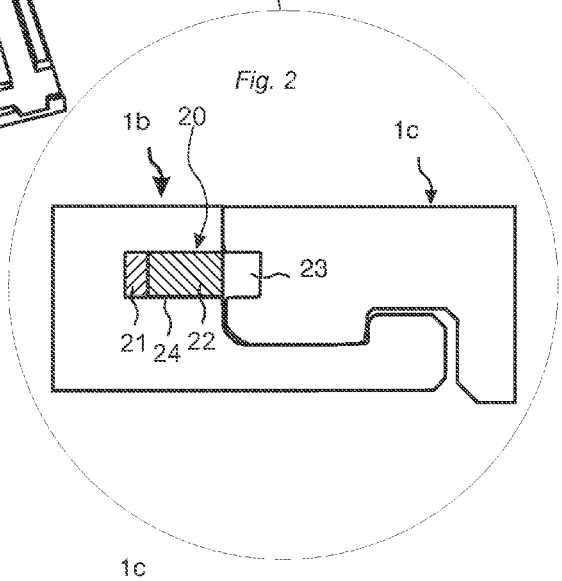
Figure 3:
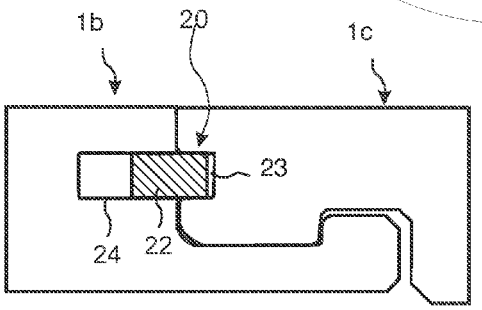

FIGS. 1-3 show floorboards provided with a known locking system which comprises a tongue 20 having an inner element 21 and an outer element 22. The tongue 20 is arranged in a displacement groove 24 at a first edge 1*b* of a first floorboard. FIG. 1 shows a position during assembling of the first floorboard. The first floorboard is arranged in a second row and is connected at a third edge to a fourth edge of a third floorboard in first row. A second floorboard is arranged in an angled position with a third edge adjacent the fourth edge of the third floorboard and a second edge 1*c* of the second floorboard is arranged adjacent the first edge 1*b* of the first floorboard.

FIG. 2 shows a cross-section of the first edge 1*b* and the second edge 1*c* after the second floorboard is angled down and connected to the third floorboard in the first row. The first edge 1*b* and the second edge 1*c* are in FIG. 2 locked together in the horizontal direction, and the inner element 21 and the outer element 22 of the tongue 20 are arranged in a first position. The first edge 1*b* and the second edge 1*c* are in the first position vertically un-locked. To lock the first edge 1*b* and the second edge 1*c* in the vertical direction, the inner element 21 is displaced and removed along the first edge 1*b*. The inner element 21 is provided with a protruding part. The protruding part pushes the outer element 22 of the tongue 20 into a tongue groove 23 at the second edge 1*c* of the second floorboard when the inner element 21 is displaced and removed.

FIG. 3 shows a cross-section of the first edge 1*b* and the second edge 1*c* in a second position. The inner element 21 of the tongue 20 is in the second position displaced and removed. The outer element 22 of the tongue 20 cooperates with the tongue groove 23 at the second edge 1*c* of the second floorboard for vertical locking of the first edge 1*b* and the second edge 1*c*.

Figure 4:
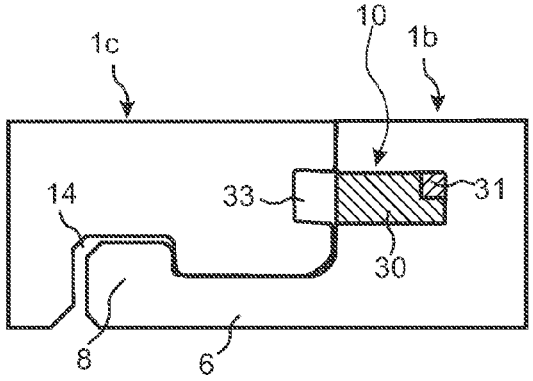
FIGS. 4-7 show a tongue comprising a guiding groove at an inner edge, according to embodiments of the present disclosure.
Figure 5:
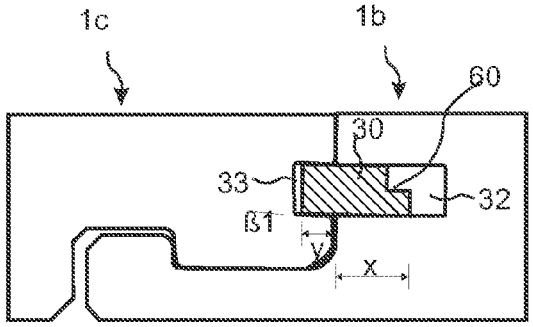

An embodiment of the present disclosure is shown in FIG. 4 and FIG. 5, with an inner and outer element 31, 30 of the tongue 10 arranged in a displacement groove 32 at a first edge 1*b* of a first floorboard. FIGS. 4 and 5 illustrate the first position and the second position, respectively, of the inner and outer elements 31, 30. The outer element 30 of the tongue 10 extends below the inner element 31 of the tongue 10, such that the inner element 31 vertically overlaps the outer element 30. The inner element 31 is in this embodiment arranged in a guiding groove 60 at an inner and upper edge of the outer element 30. The width x of a first contact surface between a lower surface of the outer element 30 of the tongue 10 and the displacement groove 32 is increased, as compared to the known locking system shown in FIG. 3, in order to improve the strength of the locking system and minimize the offset in height between the first edge 1*b* and the second edge 1*c* when a load is applied, in the second position, on the first floorboard.

The second position in which the outer element 30 is pushed into the tongue groove 33 at the second edge 1*c* is shown in FIG. 5. The outer element 30 is pushed into tongue groove 33 by a first protruding part 36 (see FIGS. 8 and 9) arranged on the inner element 31, when the inner element 31 is removed and displaced along the first edge 1*b*. A load applied on the first edge 1*b* will be taken up by a second contact surface, between an upper surface of the outer element 30 of the tongue 10 and the displacement groove 32, and a third contact surface between a lower surface of the outer element 30 of the tongue and the tongue groove 33. Since the second contact surface and the third contact surface are displaced, the load applied will result in a moment of force, which is taken up by the first contact surface. In order to increase the strength of the locking system, the width x of the first contact surface is preferably larger than the width y of the third contact surface, and preferably the width x is about twice ore more the width y. For the purpose of reducing the momentum that arises when a load is applied on the first edge 1*b*, the horizontal distance between the second and the third contact surfaces should be as small as possible, preferably less than about 1 mm and more preferably less than about 0.5 mm. This applies also to the embodiments described below.

The locking system additionally comprises in this embodiment a locking strip 6, which protrudes horizontally from the first edge 1*b*. The locking strip 6 is provided with a locking element 8 which cooperates with a locking groove 14 provided at the second edge 1*c* for horizontal locking of the first edge 1*b* and the second edge 1*c*. A load applied on the second edge 1*c* is preferably taken up by a strip contact surface between an upper surface of the locking strip 6 and a lower surface of the second edge 1*c*.

In order to push the first edge 1*b* and the second edge 1*c* vertically against each other, a lower surface of the tongue groove 33 at the third contact surface is preferably arranged with an angle β1 in relation to the horizontal plane of the floorboards. The angle β1 may be in the range of about 5° to about 20°, and preferably about 15°.

Figure 6:
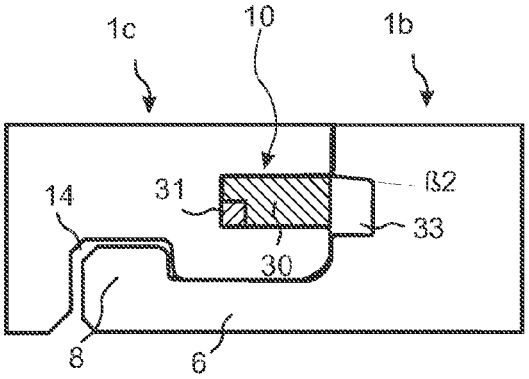
Figure 7:
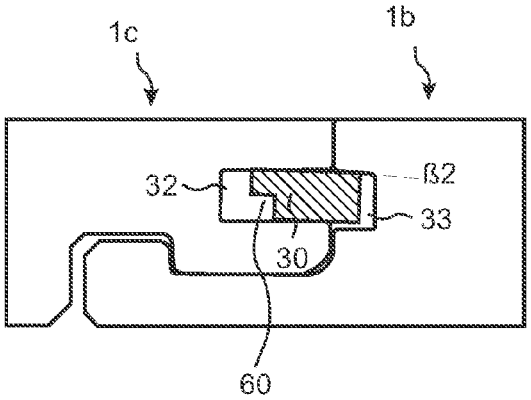

In the embodiment shown in FIGS. 6 and 7, the tongue 10 is arranged in a displacement groove 32 at the second edge 1*c*. The inner element 31 of the tongue 10 is for this embodiment preferably arranged in a guiding groove 60 at an inner and lower edge of the outer element 30 of the tongue 10 to obtain an increased first contact surface between an upper surface of the outer element 30 of the tongue 10 and the displacement groove 32. Also, in this embodiment the first contact surface takes up a momentum force resulting from a load applied at the first edge 1*b*, in a similar way as described for the embodiment shown in FIGS. 4 and 5. In order to push the first edge 1*b* and the second edge 1*c* vertically against each other, an upper surface of the tongue groove is preferably arranged with an angle β2 in relation to the horizontal plane of the floorboards. The angle β2 may be in the range of about 5° to about 20°, and preferably about 15°.

Figure 8:
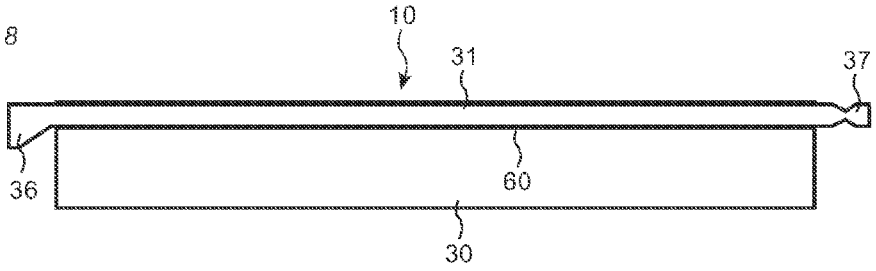
FIGS. 8 and 9 each shows a tongue from a top view, according to embodiments of the present disclosure.
Figure 9:
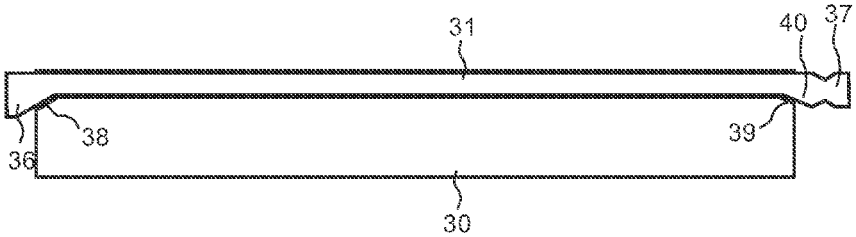

FIGS. 8 and 9 show top view embodiments of an elongated tongue 10, to be arranged in a displacement groove 32 at a first edge 1*b* of a first floorboard. The elongated tongue comprises an inner element 31, and an outer element 30. The inner element 31 is arranged in a guiding groove 60 at an inner edge of the outer element 30. The inner element 31 is preferably a bar element of an elongated shape and is provided at a first short edge with a first protruding part in the form of a wedge shaped element 36. The wedge shaped element is in a preferred embodiment guided by the guiding groove during the displacement of the inner element. The wedge shaped element 36 is configured to push the outer element 30 into a tongue groove 33 of an adjacent second edge 1*c* of a second floorboard when the inner element 31 is removed and displaced along the first edge 1*b*. The wedge shaped element 36 is, before the displacement, preferably arranged adjacent and at least partly outside a first short edge of the outer element 30 as shown in FIG. 8. A second edge of the inner element 31 is preferably provided with a gripping part 37 that facilitates the displacement of the inner element 31. FIG. 9 shows that the first short edge of the outer element 30 may be provided with first chamfer 38 that guides the wedge shaped element 36 into the guiding groove 60. The gripping part 37 is, before displacement of the inner element 31, preferably arranged adjacent a second short edge of the outer element 30 and preferably outside the second edge. As shown in FIG. 9 the inner element 31 may be provided with a second protruding part 40, for a correct positioning of the inner element 31, that before displacement of the inner element is preferably arranged in a notch or in a second chamfer 39 provided at the second short edge of the outer element 30. The outer element 30 may have a uniform cross-section from the first short edge to the second short edge. A uniform cross-section makes it possible to produce the outer element 30 at low cost, by e.g., extrusion of plastic. Also the inner element 31 may have uniform cross-section with the exception of the protruding part (wedge shaped element) 36 at the first edge. For the purpose of obtaining a correct position of the inner element 31, a preferred embodiment of the present disclosure comprises the first chamfer 38 and the second chamfer 39, which cooperate with the first protruding part 36 and the second protruding part 40, respectively.

Figure 10:
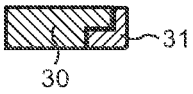
FIGS. 10 and 11 show cross-sections of a tongue comprising an L-shaped inner element, according to embodiments of the present disclosure.
Figure 11:
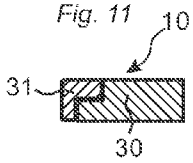
Figure 12:
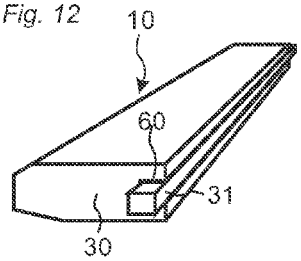
FIGS. 12-15 show tongues comprising a guiding groove at an inner surface, according to embodiments of the present disclosure.

FIGS. 10 and 11 show an embodiment of the tongue 10 comprising an L-shaped inner element 31 arranged in a corresponding guiding groove at an inner edge of the outer element 30.

Figure 13:
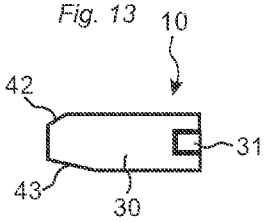
Figure 14:
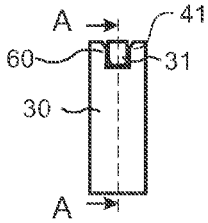
Figure 15:
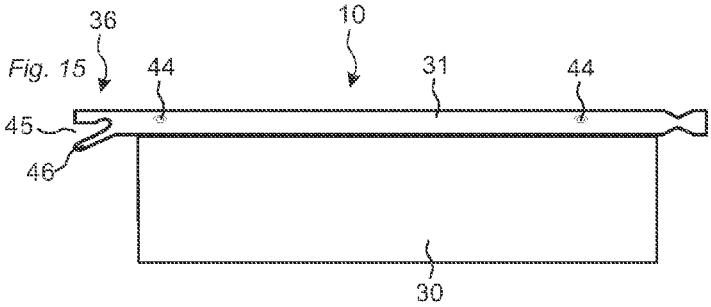

FIGS. 12-15 show an embodiment of the tongue 10 comprising inner element 31 arranged in a guiding groove 60 at an inner surface of the outer element 30. FIG. 13 shows that outer edges 42, 43 of the outer element 30 may be chamfered in order to guide the outer element 30 into the tongue groove 33. FIG. 14 shows a cross section of the tongue 10 and that the guiding groove 60 may be provided with chamfered edges 41. FIG. 15 shows a cross section of the tongue 10 in a plane indicated by AA in FIG. 14. The inner element 31 in this embodiment is provided with friction elements 44 that avert that the inner element 31 from falling out before the floorboards are installed. The first protruding part 36 is provided with a recess 45 that makes its most protruding part 46 more resilient. The most protruding part 46 may be, during the displacement of the inner element 31, compressed during, e.g., entrance of the inner element 21 into the guiding groove 60, or at any irregularities in the displacement groove 32. Also the other embodiments of the tongue 10 may be provided with a friction element 44 on the inner element 31 and/or on the outer element 30, and/or a recess 45 in the first protruding part 36.

Figure 17:
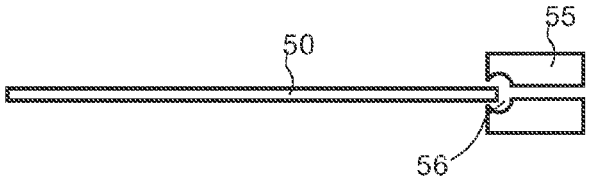
FIGS. 17-19 show a method for producing an inner element of a tongue, according to embodiments of the present disclosure.
Figure 18:
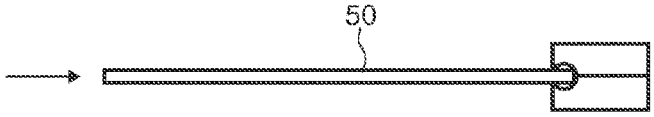
Figure 19:
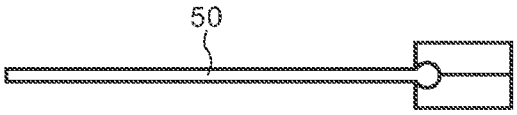
Figure 20:
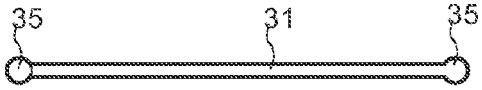
FIG. 20 shows an embodiment of an inner element of a tongue, according to an embodiment of the present disclosure.

A method for producing the first protruding part 36 and/or the second protruding part 40 of the inner element 31 is illustrated in FIGS. 17-19. A plastic blank 50 of an elongated shape is displaced into a press tool comprising a first part 55 and a second part 56. The first part 55 and the second part 56 are displaced against each other and a protruding part 35 at a first short edge of the plastic blank 50 is formed under heat and pressure. The process may be repeated for a second short edge of the plastic blank 50. The method may also comprise the step of forming the second protruding part 35 simultaneously and essentially in the same manner as the first protruding part 35. The produced first and/or second protruding part 35 may be of, for example, an essentially spherical shape or wedge shaped. FIG. 20 shows an inner element 31 that may be produced according to the method illustrated in FIGS. 17-19. The inner element 31 preferably has an essentially circular cross-section and preferably comprises protruding parts 35 of an essentially spherical shape.

Figure 21:
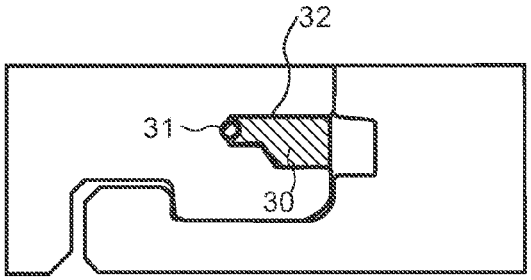
FIGS. 21 and 22 show a tongue with an inner element having a circular cross-section, according to an embodiment of the present disclosure.
Figure 22:
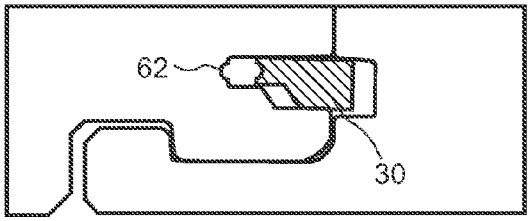

FIGS. 21 and 22 show that an inner element 31 with a circular cross section may be combined with a displacement groove 32 having an inner surface 62, which is smaller than the opening of the displacement groove 32. The inner surface 62 may be provided with a round shaped bottom that facilitates the displacement of the inner element 31.

Figure 23:
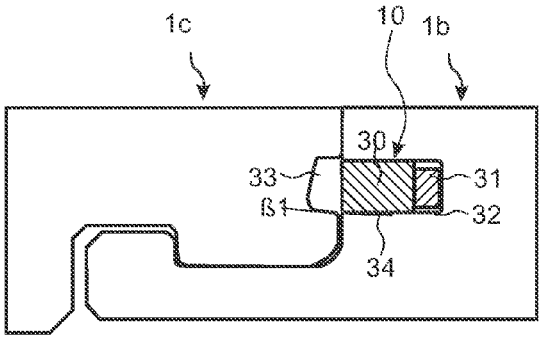
FIGS. 23-25 show a displacement groove provided with recess, according to an embodiment of the present disclosure.
Figure 24:
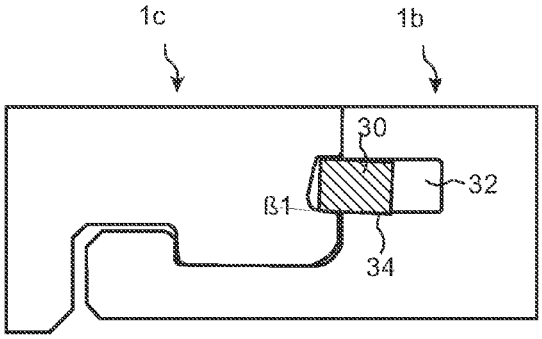
Figure 25:
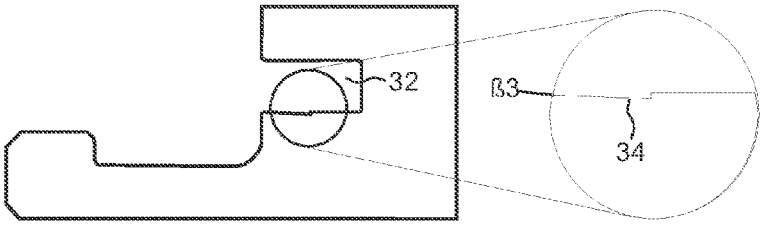

An upper or lower surface of the displacement groove 32 may be provided with a recess 34 having an angled surface at an angle β3 to the horizontal plane. The angle β3 may be in the range of about 3° to about 10°. An embodiment of the recess 34 is shown in FIGS. 23-25. The recess 34 and the angled surface has the effect that the outer element 30 of the tongue 10 tilts and the outer element 30 is restrained from being displaced back into the displacement groove 32 after the outer element 30 is pushed into the tongue groove 33 by the inner element 31. Such a recess 34 may be provided in locking systems comprising any type of the disclosed displaceable tongue.

Figure 26:
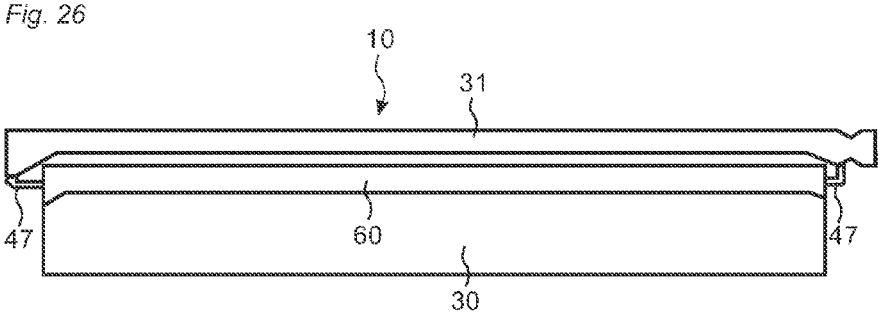
FIG. 26 shows a tongue from a top view, according to an embodiment of the present disclosure.

A preferred embodiment of the tongue 10 is shown in FIG. 26. The inner element 31 and the outer element 30 are produced in one piece by injection moulding of plastic. The inner element 31 and the outer element 30 are connected together by a connection 47 configured to break when the inner element is displaced or when the tongue is inserted into the displacement groove.

The invention claimed is:

1. Floorboards including at least a first floorboard and a second floorboard provided with a mechanical locking system comprising:

a displacement groove at a first edge of the first floorboard and a tongue groove at a second edge of the second floorboard, a tongue arranged in the displacement groove and configured to cooperate, in a second position, with the tongue groove for vertical locking of the first edge and the second edge, the tongue comprises, in a first position, an inner element and an outer element, the inner element being removable along the displacement groove and configured to cooperate with the outer element to obtain a displacement of the outer element towards the tongue groove and thereby obtain the second position, wherein said inner element and said outer element vertically overlap each other in the first position.

2. Floorboards as claimed in claim 1, wherein the inner element in the first position is arranged above or below the outer element.

3. Floorboards as claimed in claim 1, wherein the inner element in the first position is arranged partly above and partly behind the outer element, or is arranged partly below the outer element and partly behind the outer element.

4. Floorboards as claimed in claim 1, wherein the outer element is provided with a guiding groove at either an inner and upper edge of the outer element or at an inner and lower edge of the outer element, and at least a part of the inner element in the first position is arranged in said guiding groove.

5. Floorboards as claimed in claim 1, wherein the outer element is provided with a guiding groove at an inner surface of the outer element, between an upper surface and a lower surface of the outer element, and at least a part of the inner element is arranged in said guiding groove in the first position.

6. Floorboards as claimed in claim 4, wherein the guiding groove extends essentially along the whole longitudinal length of the outer element.

7. Floorboards as claimed in claim 4, wherein the inner element comprises a first protruding part configured to cooperate with the guiding groove, to obtain said displacement of the outer element.

8. Floorboards as claimed in claim 7, wherein the first protruding part in the first position is arranged outside of the outer element.

9. Floorboards as claimed in claim 6, wherein the first protruding part is one of wedge shaped and essentially spherical shaped.

10. Floorboards as claimed in claim 1, wherein a cross section of the inner element is one of an L-shape, rectangular shape, and an essentially circular shape.

11. Floorboards as claimed in claim 1, wherein the entire outer element is arranged within the displacement groove in the first position.

12. Floorboards as claimed in claim 1, wherein the floorboards comprise a wood-based core made of at least one of MDF, HDF, OSB, WPC (Wood Powder Composite), and particleboard.

13. Floorboards as claimed in claim 1, wherein the floorboards comprise a plastic core.

14. Floorboards as claimed in claim 7, wherein the first protruding part in the first position is arranged at least partly in a recess of the outer element.

15. Floorboards as claimed in claim 14, wherein the first protruding part is one of wedge shaped and essentially spherical shaped.

16. Floorboards as claimed in claim 1, wherein the outer element includes two opposed long edges, and a first short edge and second short edge which oppose each other, and the outer element has a uniform cross-section from the first short edge to the second short edge.

17. Floorboards as claimed in claim 1, wherein the inner element includes two opposed long edges, a first short edge and second short edge which oppose each other, and a protruding part at the first short edge, wherein the inner element has a uniform cross-section with the exception of the protruding part at the first short edge.

18. Floorboards as claimed in claim 1, wherein the outer element has a rectangular shape in plan view as seen from above the floorboards.

19. Floorboards as claimed in claim 1, wherein the outer element has a substantial rectangular shape in plan view as seen from above the floorboards, and two corners of the substantial rectangular shape which face the inner element each have a chamfer.

* * * * *